US006494275B2

(12) United States Patent
Åsberg et al.

(10) Patent No.: US 6,494,275 B2
(45) Date of Patent: Dec. 17, 2002

(54) ROCK DRILL BIT HAVING RETRAC TEETH AND METHOD FOR ITS MANUFACTURING

(75) Inventors: Bengt Åsberg, Åshammar (SE); Kenneth Larsson, Sandviken (SE); Bertil Ederyd, Gävle (SE)

(73) Assignee: Sandvik AB, Sandviken (SE)

( * ) Notice: Subject to any disclaimer, the term of this patent is extended or adjusted under 35 U.S.C. 154(b) by 26 days.

(21) Appl. No.: 09/796,440

(22) Filed: Mar. 2, 2001

(65) Prior Publication Data

US 2001/0018990 A1 Sep. 6, 2001

(30) Foreign Application Priority Data

Mar. 2, 2000 (SE) ..... 0000688

(51) Int. Cl.[7] ..... E21B 10/00
(52) U.S. Cl. ..... 175/401; 175/415
(58) Field of Search ..... 175/401, 415, 175/417, 418, 419

(56) References Cited

U.S. PATENT DOCUMENTS

| | | | | |
|---|---|---|---|---|
| 2,746,722 A | | 5/1956 | Schneider | |
| 2,821,364 A | * | 1/1958 | Godfrey | 175/401 |
| 3,094,180 A | * | 6/1963 | Haith | 175/401 |
| 3,145,789 A | | 8/1964 | Lawry | |
| 3,313,364 A | * | 4/1967 | Binkley | 175/401 |
| 4,262,762 A | | 4/1981 | Potratz | |
| 4,598,779 A | | 7/1986 | Liljekvist et al. | |
| 4,986,345 A | | 1/1991 | Maher | |
| 5,743,345 A | | 4/1998 | Hollar et al. | 175/401 |
| 6,213,231 B1 | * | 4/2001 | Von Haas | 175/401 |

* cited by examiner

*Primary Examiner*—William Neuder
(74) *Attorney, Agent, or Firm*—Burns, Doane, Swecker & Mathis, LLP

(57) ABSTRACT

A rock drill bit for percussive drilling, especially top hammer drilling, includes a bit head provided with front rock crushing buttons and a skirt. The bit head is provided with a number of grooves formed in the outside of the skirt and extending in the axial direction of the drill bit. Protruding lands are defined between the grooves, which likewise extend in the axial direction. Axially rearward ends of at least some of the lands are formed with retrac teeth. Each retrac tooth has a cutting edge extending along an outer circumference of the skirt.

7 Claims, 4 Drawing Sheets

8
7
19
18
17
1
5
15
20
19
18
17
17
16
3
16
17
17
11
17
11

ROCK DRILL BIT HAVING RETRAC TEETH AND METHOD FOR ITS MANUFACTURING

RELATED INVENTION

This application claims priority under 35 U.S.C. §§ 119 and/or 365 to Patent Serial No. 0000688-2 filed in Sweden on Mar. 2, 2000, the entire content of which is hereby incorporated by reference.

1. Technical Area of the Invention

The present invention relates to a rock drill bit for percussive drilling, especially for top hammer drilling, and a method for the manufacturing of a rock drill bit.

2. Prior Art

A percussive drill bit and its associated drill string comprising drill rods shall be removed from a drilled hole after the hole is completed. During removal, the drill bit and the drill string are usually rotated in an opposite direction compared to the direction employed for drilling of the drilled hole. However, the removal of the drill bit and drill string from the drilled hole is impaired by loose rock material from the bore wall. To correct this problem it is customary that the drill bit has at its rear end, i.e., at the end surface facing away from a drill bit front surface, inserts or chisels, hereinafter called retrac teeth, which during rotation of the drill string and the drill bit, in connection with retraction of the drill string and the drill bit from the drilled hole, crush the rock material which has become loosened from the bore wall. The retrac teeth are made by means of special milling operations, which consequently constitutes additional manufacturing operations besides the usual operations for the manufacturing of a rock drill bit of the current type. However, the shaping of these known teeth at the rear end of the drill bit results in the formation of teeth having sharp corners. This promotes the generation of cracks in the teeth during operation of the drill bit.

U.S. Pat. No. 5,743,345 shows in FIG. 3 thereof a rock drill bit with an associated drill rod, where the drill bit is provided with special cemented carbide buttons at its rear end, which function in a corresponding manner to the above-described retrac teeth. The provision of special cemented carbide buttons at the rear end of the drill bit makes the manufacturing of a rock drill bit of the current type more expensive.

OBJECTS AND SUMMARY OF THE INVENTION

One object of the present invention is to provide a rock drill bit of the above-captioned type, wherein the retrac teeth of said rock drill bit are formed such that crack formation is avoided to a high degree in connection with said retrac teeth.

Another object of the present invention is to provide retrac teeth which permit the transfer of impact energy between the drill bit and the drill rod situated closest to the drill bit by means of so-called shoulder abutment.

The objects of the present invention are realized by a rock drill bit for percussive drilling comprising a head which defines a longitudinal center axis. The head includes an axially forward rock-crushing surface and a skirt extending axially rearwardly from the rock-crushing surface. An outer circumferential surface of the skirt is formed with circumferentially spaced apart grooves which form lands therebetween. The grooves and the lands extend at least generally in an axial direction. An axial rear portion of at least some of the lands form retrac teeth for crushing rock during withdrawal of the bit from a hole. Each retrac tooth includes a cutting edge extending along an outer circumference of the skirt.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT

Figure 1:
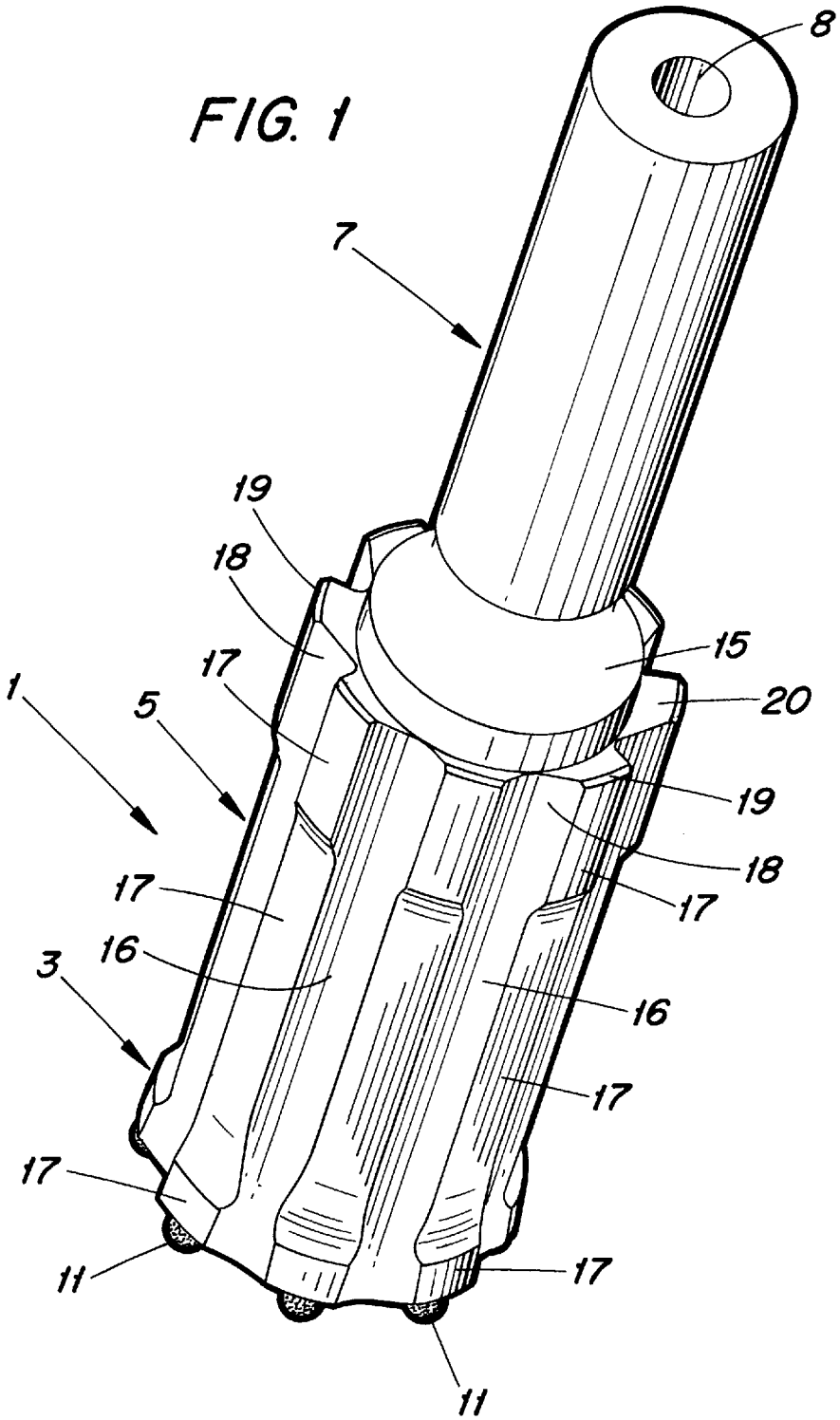
FIG. 1 shows a perspective view of a rock drill bit according to the present invention, wherein a drill rod is connected with the drill bit.
Figure 2:
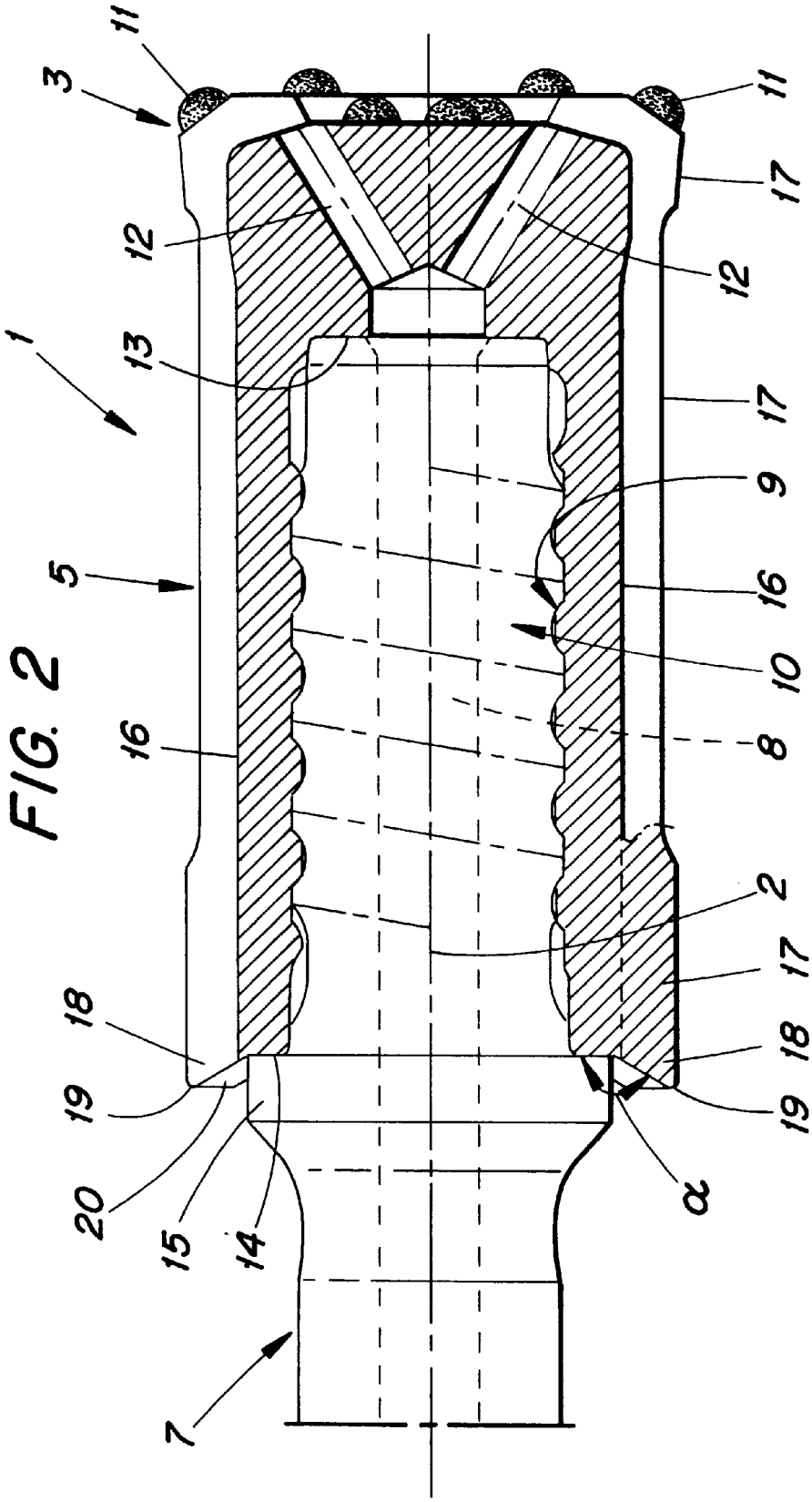
FIG. 2 shows a longitudinal cross-section through the drill bit according to FIG. 1, wherein the cross-section runs through a retrac tooth, and an associated drill rod is shown schematically.
Figure 3:
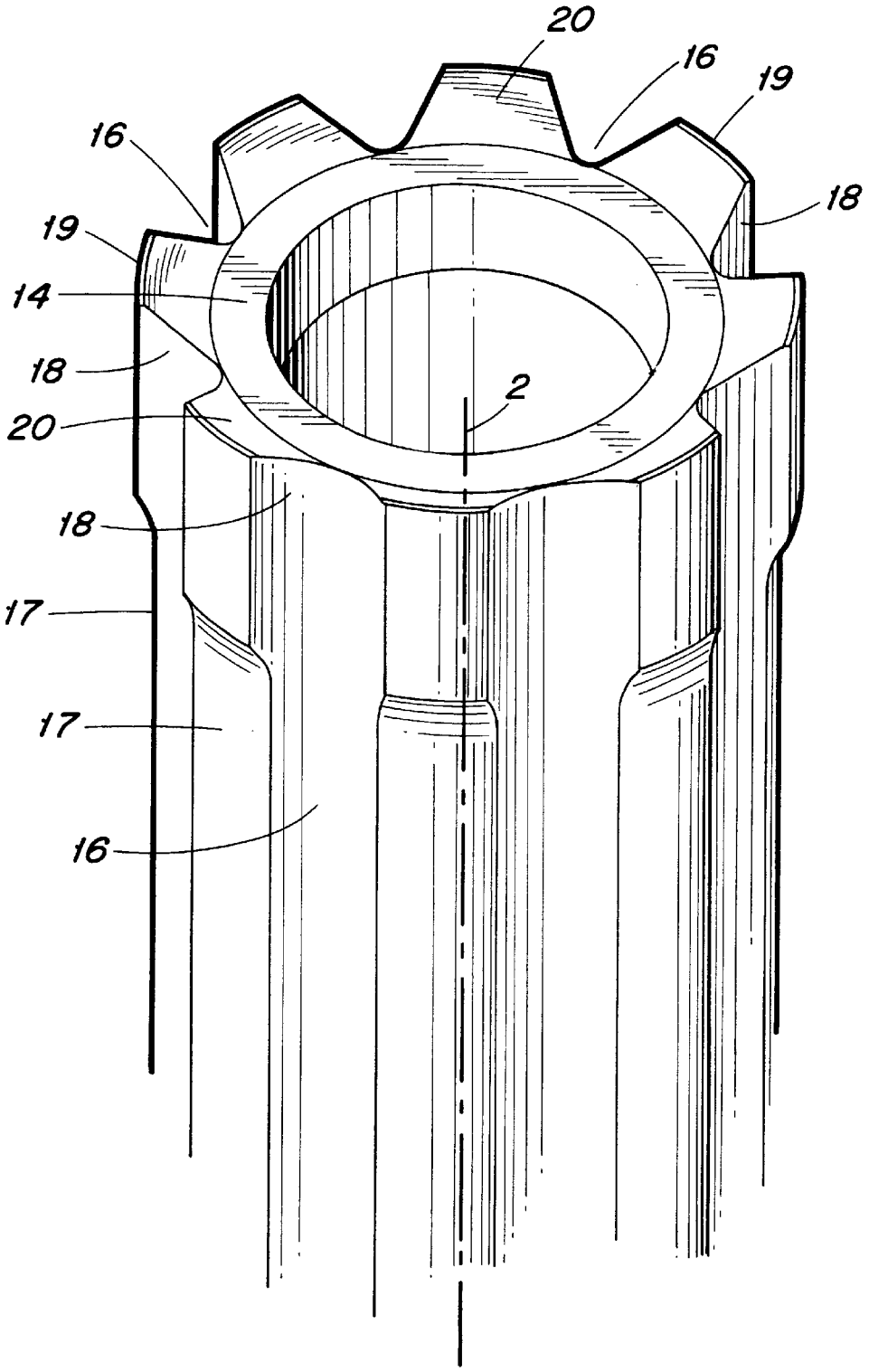
FIG. 3 shows a perspective view of a rear part of the drill bit according to FIG. 1; and, FIG. 4 shows a longitudinal cross-section through the drill bit according to FIGS. 1–3 according to the present invention, wherein the cross-section runs through a retrac tooth, and an alternative associated drill rod is shown schematically.

The drill bit 1 shown in FIGS. 1–3 comprises a bit head 3 and a shank or a skirt 5, said bit head 3 and the skirt 5 being integral with each other. A schematically shown drill rod 7 is connected with the drill bit 1 via a thread joint. A through-going flush channel 8 is in a usual manner provided in the drill rod 7 along a longitudinal center axis 2 common for the drill bit 1 and the drill rod 7.

As is most visible in FIG. 2, the drill bit 1 is provided with an internal recess having a female thread 9, which receives an external male thread 10 disposed at one end surface of the drill rod 7.

The bit head 3 of the drill bit 1 according to the present invention is in a usual manner provided with rock crushing means, in the shape of cemented carbide buttons in the shown embodiment, of which several annularly positioned peripheral buttons 11 are shown. Several flushing channels 12 extend between the internal space of the drill bit 1 defined by the female thread 9, and the front of the bit head 3. There is also provided an axially rearwardly facing first abutment surface 13 in said internal space, a so-called bottom abutment, for abutting the free end of the drill rod 7.

There is provided an axially rearwardly facing second abutment surface 14, a so-called shoulder abutment, at the rear end of the drill bit 1, which is best visible in FIG. 3, which is intended to cooperate with a shoulder 15 on the drill rod 7. In the embodiment shown in FIGS. 1–3 there is normally used a so-called shoulder-bottom abutment, which means that the drill rod 7 is made with such tolerances during forming of the threaded connection between the drill bit 1 and the drill rod 7 that the free end of the drill rod 7 initially engages the bottom abutment before engaging the shoulder abutment 14. After a relatively short time, the wearing of the threaded connection causes the shoulder 15 of the drill rod 7 to engage the shoulder abutment 14, whereby a so-called shoulder-bottom abutment has been formed, i.e., abutments between the drill bit 1 and the drill rod 7 occur at both the bottom abutment surface 13 and the shoulder abutment surface 14. This means that transfer of the impact energy from the drill rod 7 to the drill bit 1 will occur at both the bottom abutment 13 and the shoulder abutment 14.

As is best seen in FIGS. 1 and 3, the drill bit 1 is provided with a number of straight grooves 16 for conducting drill cuttings on its external surface, which grooves extend in the axial direction of the drill bit 1 and therebetween define a number of straight protruding lands 17, which likewise extend in the axial direction of the drill bit 1, i.e., parallel to the center axis 2. As is seen in FIGS. 1–3, each protruding land 17 has a reduced height (radial dimension) along an intermediate part of its length. This reduction of material at intermediate parts of the protruding lands 17 ensures that guiding of the drill bit 1 in the drilled hole occurs by means of the full-height parts of the protruding lands 17 situated at respective ends of each land. The grooves 16 are in the usual manner intended to transport away the drill dust generated at the front of the drill bit 1.

As can be seen in FIGS. 1–3, the protruding lands 17 are formed with retrac teeth 18 at their rear ends, i.e., the ends facing away from the rock crushing end of the drill bit 1, which teeth are intended, during retraction of the drill bit 1 from a drilled hole, to crush the material which has loosened from the bore wall. Each retrac tooth 18 is provided with a cutting edge 19, which is situated on the respective protruding land 17 at a location situated farthest from the central axis 2. The cutting edges 19 extend along, i.e., lie on, an outer circumference of the skirt and coincide with an imaginary cylinder that intersects the peripheral buttons 11 of the drill bit 1.

The retrac teeth 18 according to the present invention can be formed in a simple and rational manner in connection with the manufacture of the drill bit 1 according to the present invention. The end where the retrac teeth shall be formed is turned in a lathe during said manufacturing, whereby to form the second abutment surface 14 and a concentrical outer rear surface 20, which forms an angle $\alpha$ of less than 180 degrees with the inner second abutment surface 14. In a subsequent step during manufacturing of the drill bit 1 according to the present invention the grooves 16 are formed on the outside of the drill bit 1, preferably through milling. Thereby the protruding lands 17 situated between the grooves 16 for drill cuttings are formed automatically. Reduction of the height of the intermediate portions of the lands 17 is suitably made by means of milling.

During the formation of the protruding lands 17, the retrac teeth 18 are inherently formed at the ends of the protruding lands 17 which face away from the rock crushing end of the drill bit 1. The retrac teeth 18 will be formed with the edges 19 that are situated on the outer diameter of the skirt 5 since the concentric, rear surface 20 forms the angle $\alpha$ that is less than 180 degrees, with the inner second abutment surface 14. Thus also each retrac tooth 18 will include a portion of the surface 20 facing generally away from the rock crushing end of the drill bit 1. The rear surfaces 20 coincide with a cone having an imaginary cone apex directed towards the rock-crushing end of the drill bit 1. That is, each surface is inclined in an axially forward and radially inward direction. A substantial advantage of the retrac teeth 18 formed in that manner is that there are no sharp corners associated with said teeth 18. Thereby the danger for crack formation in connection with said retrac teeth 18 is reduced to a high degree.

In other words, the method for manufacturing of the rock drill bit from a cast blank, not shown, comprises the following steps:

A) turning the rock crushing end surface and the rear surface 20, whereby the end surface forms the angle $\alpha$ of less than 180 degrees with the plane 21, and B) forming the grooves 16 for drill cuttings on the outside of the drill bit 1, preferably by milling, which grooves are made to extend between the rock crushing end surface and the surface 20 of the drill bit. The intermediate protruding lands 17 are formed due to the development of the grooves, wherein the rear end portions of the lands define the retrac teeth 18, which have edges 19 extending along the outer circumference of the skirt 5. In addition, portions of the surface 20 are formed on the respective retrac teeth. Furthermore, when the surface 20 is turned, a second abutment surface 14 is achieved, which is concentric with and situated inside the surface 20. Also, some of the retrac teeth may be removed by means of a subsequent machining, preferably by milling.

Figure 4:
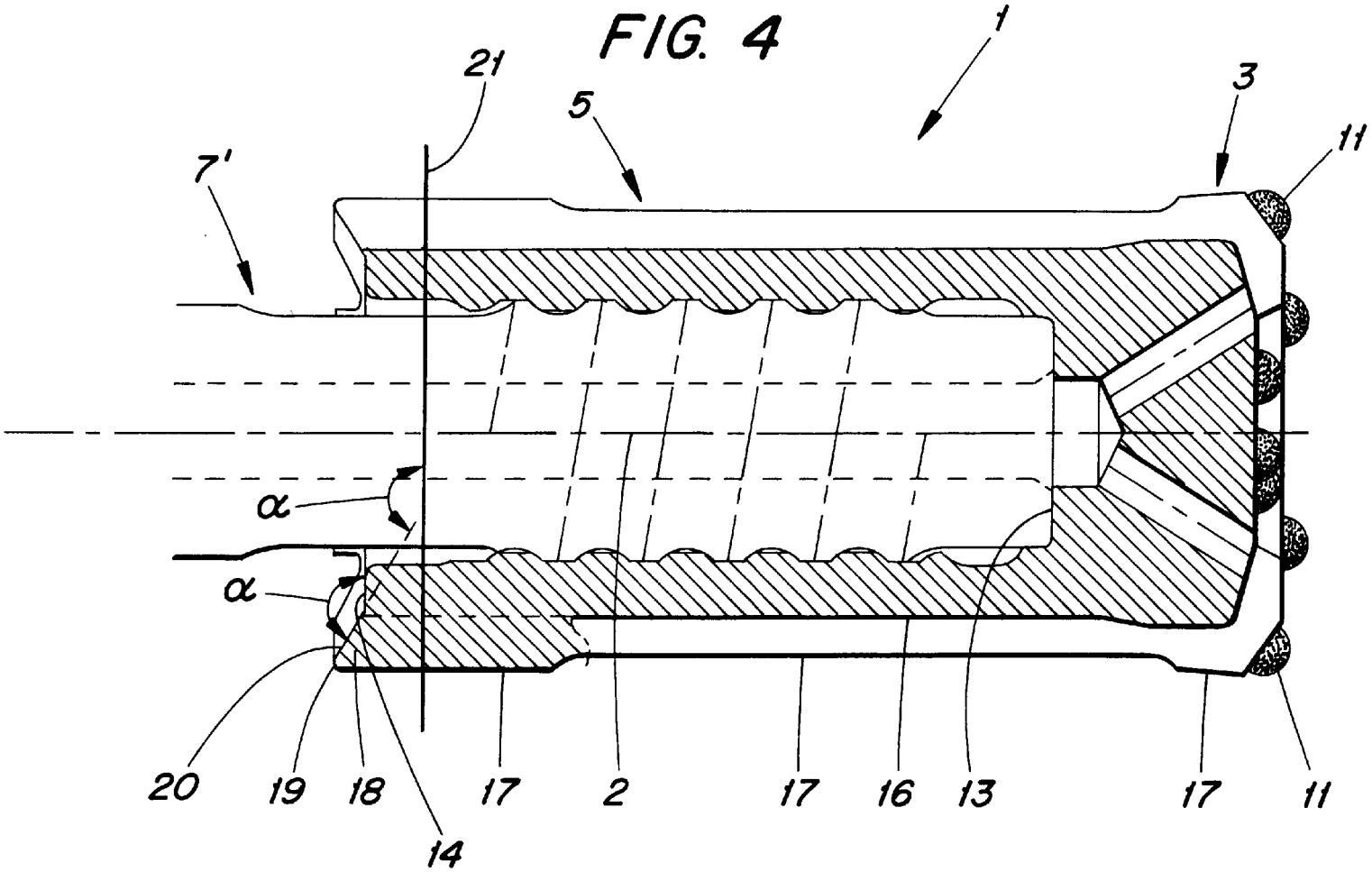

In FIG. 4 is shown a rock drill bit 1 according to FIGS. 1–3 connected to a drill rod 7', which has an alternative design when compared to the drill rod 7 according to FIGS. 1–2. The principal difference between the drill rod 7 according to FIGS. 1–3 and the drill rod 7' according to FIG. 4 is that the latter is designed without a shoulder 15. In a joint of the drill bit 1 and the drill rod 7' according to FIG. 4, the transfer of shock wave energy exclusively occurs through a so-called bottom abutment, i.e., where the free end surface of the drill rod 7' abuts against the first abutment surface 13 of the drill bit 1. Even if the drill bit 1 according to FIG. 1 is basically the same as the drill bit 1 according to FIG. 4, the axial distance between the first abutment surface 13 and the second abutment surface 14 can be larger if a drill rod 7' according to FIG. 4 is used. The reason thereto is of course that the drill rod 7' does not have any shoulder, i.e., the second abutment surface 14 is in principle not used.

CONCEIVABLE MODIFICATIONS OF THE INVENTION

In the above-described embodiment of the drill bit 1, the grooves 16 and the protruding lands 17 are straight and extend exactly in the axial direction of the drill bit 1. However, within the scope of the present invention the grooves and the associated protruding lands may, for example, extend helically on the surface of the drill bit and thus would be considered as extending generally in the axial direction. Alternatively, the grooves and lands could extend straight, but at an inclination relative to the axis and thus would also be considered as extending generally in the axial direction According to the above-described embodiment of the drill bit 1, retrac teeth 18 are formed between each adjacent pair of grooves 16. Within the scope of the present invention for example every second retrac tooth 18 may be removed, e.g., by milling-away the rear portions of respective lands. The number of retrac teeth 18 that a rock drill bit 1 according to the present invention could exhibit is based upon many different parameters, wherein for exemplifying and not limiting purpose can be mentioned: (i) the diameter of the drill bit, (ii) the type of rock being drilled, and (iii) the type of drilling-rig being used.

In the embodiment according to FIG. 4, the abutment surface 14 is not needed, as noted earlier, so the surface 20 could extend all the way to the inner diameter of the drill bit. Thus, the angle a would be formed by the surface 20 and the imaginary plane 21 which extends perpendicularly to the center axis 2 of the drill bit (i.e., the plane 21 is parallel to the surface 14 which also extends perpendicular to the axis 2).

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A rock drill bit for percussive drilling comprising a head defining a longitudinal center axis, the head including an axially forward rock-crushing surface and a skirt extending axially rearwardly from the rock-crushing surface, a circumferential outer surface of the skirt formed with circumferentially spaced apart grooves forming lands therebetween, the grooves and the lands extending at least generally in an axial direction, an axial rear portion of at least some of the lands forming retrac teeth for crushing rock during withdrawal of the bit from a hole, each retrac tooth including a curved cutting edge extending along an outer circumference of the skirt and lying in an imaginary plane oriented perpendicularly to the center axis.

2. The rock drill bit according to claim 1 wherein each retrac tooth further includes an axially rearwardly facing rear surface disposed radially inside of the respective cutting edge and inclined from the cutting edge in an axially forward and radially inward direction to form an angle less than 180 degrees with the imaginary plane.

3. The rock drill bit according to claim 1 wherein the head further includes an internal recess extending along the axis and opening in an axially rearward direction, a surface of the recess having a female screw thread formed thereon; the recess terminating at a location axially rearwardly of the rock-crushing surface, wherein the head forms an axially rearwardly facing front abutment surface that defines a front end of the recess.

4. The rock drill bit according to claim 1 wherein the cutting edges lie on an imaginary cylinder that is coaxial with the skirt; the bit further including rock-crushing buttons mounted in the rock-crushing surface; some of the buttons being intersected by the imaginary cylinder.

5. The rock drill bit according to claim 2 wherein the axially rearwardly facing surface constitutes a first axially rearwardly facing surface, the head further including a second axially rearwardly facing surface extending radially inwardly from the first axially rearwardly facing surface, the second axially rearwardly facing surface defining a rear abutment surface.

6. A rock drill bit for percussive drilling comprising a head defining a longitudinal center axis, the head including an axially forward rock-crushing surface and a skirt extending axially rearwardly from the rock-crushing surface, a circumferential outer surface of the skirt formed with circumferentially spaced apart grooves forming lands therebetween, the lands extending parallel to the center axis, the grooves and the lands extending at least generally in an axial direction, an axial rear portion of at least some of the lands forming retrac teeth for crushing rock during withdrawal of the bit from a hole, each retrac tooth including a curved cutting edge extending along an outer circumference of the skirt and lying in an imaginary plane oriented perpendicularly to the center axis;

each retrac tooth further including a first axially rearwardly facing surface disposed radially inside of the respective cutting edge and inclined from the cutting edge in an axially forward and radially inward direction to form an angle less than 180 degrees with an imaginary plane extending perpendicular to the axis;

the head further including an internal recess extending along the axis and opening in an axially rearward direction, a surface of the recess having a female screw thread formed thereon; the recess terminating at a location axially rearwardly of the rock-crushing surface, wherein the head forms an axially rearwardly facing front abutment surface that defines a front end of the recess;

the head further including a second axially rearwardly facing surface extending radially inwardly from the first axially rearwardly facing surface, the second axially rearwardly facing surface defining a rear abutment surface.

7. A rock drill bit for percussive drilling comprising a head defining a longitudinal center axis, the head including an axially forward rock-crushing surface and a skirt extending axially rearwardly from the rock-crushing surface, a circumferential outer surface of the skirt formed with circumferentially spaced apart grooves forming lands therebetween, the lands extending parallel to the center axis, the grooves and the lands extending at least generally in an axial direction, an axial rear portion of at least some of the lands forming retrac teeth for crushing rock during withdrawal of the bit from a hole, each retrac tooth including a cutting edge extending along an outer circumference of the skirt, each cutting edge defined by the intersection between a respective land and a rear surface which is inclined from the cutting edge in an axially forward and radially inward direction, the rear surface forming an angle less than 180 degrees with an imaginary plane extending perpendicularly to the center axis.

* * * * *